US009169046B2

(12) United States Patent
Weldon

(10) Patent No.: US 9,169,046 B2
(45) **Date of Patent: *Oct. 27, 2015**

(54) BALL DISPLAY CASE

(71) Applicant: INDUCOMP Corporation, Pacific, MO (US)

(72) Inventor: John T. Weldon, Pacific, MO (US)

(73) Assignee: Inducomp Corporation, Pacific, MO (US)

( * ) Notice: Subject to any disclaimer, the term of this patent is extended or adjusted under 35 U.S.C. 154(b) by 81 days.

This patent is subject to a terminal disclaimer.

(21) Appl. No.: 13/858,572

(22) Filed: Apr. 8, 2013

(65) Prior Publication Data

US 2013/0220853 A1 Aug. 29, 2013

Related U.S. Application Data

(62) Division of application No. 12/392,953, filed on Feb. 25, 2009, now Pat. No. 8,413,807.

(51) Int. Cl.

| | |
|---|---|
| ***B65D 85/00*** | (2006.01) |
| ***B65D 43/02*** | (2006.01) |
| ***A47G 33/00*** | (2006.01) |
| ***A63B 47/00*** | (2006.01) |
| ***E05B 65/52*** | (2006.01) |

(52) U.S. Cl.

CPC ..... *B65D 43/0235* (2013.01); *A47G 33/004* (2013.01); *A63B 47/00* (2013.01); *E05B 65/52* (2013.01); *Y10T 70/8514* (2015.04); *Y10T 292/694* (2015.04)

(58) Field of Classification Search

USPC ..... 206/821, 765, 764, 315.9, 771, 779, 206/780, 493; 211/14; 40/743.1; 428/3

See application file for complete search history.

(56) References Cited

U.S. PATENT DOCUMENTS

| | | | |
|---|---|---|---|
| 2,551,354 | A | 5/1951 | Wasilevich |
| 3,281,883 | A | 11/1966 | Glantz |
| 3,533,503 | A | 10/1970 | Wood et al. |
| D260,864 | S | 9/1981 | Perry |

(Continued)

FOREIGN PATENT DOCUMENTS

| | | | |
|---|---|---|---|
| KR | 20020013340 | A | 2/2002 |
| WO | 2010/107564 | A2 | 9/2010 |

OTHER PUBLICATIONS

Facts & Specifications Sheet Optium Acrylic Products Tru Vue, brochure, 2008, 4 pgs, McCook, IL.

(Continued)

*Primary Examiner* — Anthony Stashick
*Assistant Examiner* — Robert Poon
(74) *Attorney, Agent, or Firm* — Senniger Powers LLP

(57) ABSTRACT

A ball display case has base and a cover that is securable to the base. The cover and base at least partially enclose a space for holding a ball when the cover is secured to the base. The cover can be moved to a position in which the cover cannot be non-destructively removed from the base without moving the cover relative to the base away from this position. A lock is adapted for selective application to at least one of the base and the cover. The lock prevents non-destructive movement of the cover away from the position. The lock is adapted for selectively and irreversibly converting the display case from an unlocked condition in which the cover is releasably secured to the base to a locked condition in which the cover cannot be non-destructively removed from the base.

9 Claims, 15 Drawing Sheets

(56) References Cited

U.S. PATENT DOCUMENTS

| | | | | |
|---|---|---|---|---|
| 4,955,485 | A | 9/1990 | Alton | |
| 5,082,110 | A | 1/1992 | Hager | |
| 5,165,538 | A | 11/1992 | Peters | |
| 5,379,892 | A | 1/1995 | Reams et al. | |
| 5,487,600 | A | 1/1996 | Griffin | |
| D370,868 | S | 6/1996 | Phelps | |
| D391,100 | S | 2/1998 | Hawkersmith | |
| 5,791,075 | A | 8/1998 | Martell | |
| 5,827,581 | A | 10/1998 | Cobb et al. | |
| 5,918,393 | A | 7/1999 | Martell | |
| 6,016,910 | A | 1/2000 | Rodearmel | |
| 6,047,833 | A | 4/2000 | Salomon | |
| 6,112,894 | A * | 9/2000 | Kikuchi et al. | 206/308.1 |
| 6,199,804 | B1 | 3/2001 | Donofrio, Jr. | |
| 6,268,027 | B1 | 7/2001 | Wu | |
| D464,216 | S | 10/2002 | Rone | |
| 6,562,423 | B2 | 5/2003 | Rubin | |
| 6,887,138 | B2 * | 5/2005 | Bottema et al. | 451/72 |
| 7,185,760 | B2 | 3/2007 | Schauer et al. | |
| D667,240 | S | 9/2012 | Weldon | |
| D670,935 | S | 11/2012 | Weldon | |
| D671,336 | S | 11/2012 | Weldon | |
| 8,413,807 | B2 * | 4/2013 | Weldon | 206/315.9 |
| 2001/0050239 | A1 * | 12/2001 | Ishii | 206/308.1 |
| 2003/0104773 | A1 * | 6/2003 | Krondorfer et al. | 451/342 |
| 2007/0028498 | A1 | 2/2007 | Knepper et al. | |
| 2008/0067086 | A1 | 3/2008 | Uidl | |
| 2009/0166228 | A1 | 7/2009 | Kinunen | |

OTHER PUBLICATIONS

Pro-Mold, "Baseball Holders—UV Protectant Ball Cube III", www.pro-mold.com/pcbsquareiiiUV.htm, published at least as early as May 21, 2009, 1 pg.

PSA/DNA Authentication Services, "Do you have the Balls", www.psadna.com/ball/index.chtml, published at least as early as May 21, 2009, 1 pg.

* cited by examiner

BALL DISPLAY CASE

CROSS REFERENCE TO RELATED APPLICATION

The present application is a divisional application of U.S. application Ser. No. 12/392,953, filed Feb. 25, 2009, which will be issued as U.S. Pat. No. 8,413,807 on Apr. 9, 2013, the entire contents of which are hereby incorporated by reference.

FIELD OF INVENTION

The present invention relates generally to a case for displaying and protecting an item of sports memorabilia and more particularly to a case for displaying and protecting a ball, such as a valuable autographed ball.

BACKGROUND

The value of a ball or other item of sports memorabilia can be substantial if it is autographed or if it was involved in an event of historical significance. For example, a baseball autographed by Babe Ruth in average condition can sell for about $25,000. Some people may also want to keep a ball or other item as souvenir for personal reasons that do not necessarily translate into a high market value for the item. It is sometimes worthwhile to protect these prized items from degradation to preserve their condition. In the case of a high market value item, the value can be affected by the item's condition. Sometimes the owner of an item will have a memorabilia expert examine it to certify its authenticity and grade its condition. The expert's certification is more meaningful if there are assurances the certified item has not been replaced with a fake and that its condition has not deteriorated in the time since it was previously examined by the expert.

Various display cases are available for displaying baseballs and other sports memorabilia. For example, U.S. Pat. No. 5,165,538 (Peters) discloses a baseball holder in which a baseball is held in the space between two hemispherical shells that cover and protect the baseball. U.S. Pub. Pat. App. No. 20080067086 (Uidl) discloses a baseball display case in which a baseball is supported under a protective dome on a support that can be rotated by a motor so the baseball rotates under the dome. U.S. Pat. No. 5,082,110 (Hager) discloses a protective case for an autographed baseball in which a transparent dome is fused to a baseplate by sonic welding or dielectric heating to hermetically seal the baseball in the case and protect against tampering. The Hager patent discloses that an appraisal and authentication service can seal a documentation card between layers of the base plate when the dome is fused to the base plate to display information about the baseball, such as authentication and grading information.

Various sports memorabilia experts provide authentication and/or grading services. These services are sometimes provided at public memorabilia shows. At these shows, customers typically present a ball for authentication and/or grading at a booth set up for the show. After the ball has been authenticated and/or graded, the customer may be offered the opportunity to have the ball placed in a display case that includes a certification of the expert's opinion as to the ball's authenticity and condition.

There are some constraints on the type of equipment that can be used to enclose a ball in a tamper resistant case at a public show. For example, some equipment (e.g., sonic welders) generates substantial noise and would create a nuisance if used at a public show. Also, there is a limited amount of space available at public shows for booths. Further, booths are typically taken down after the show and transported to another location, e.g., another show. Thus, equipment that is bulky or that is not readily portable presents problems.

The present inventors have developed various improvements to cases for displaying prized pieces of sports memorabilia while protecting them against degradation and/or tampering.

SUMMARY

One aspect of the invention is a ball display case. The display case has a base and a cover that is securable to the base. The cover and base at least partially enclosed a space for holding a ball when the cover is secured to the base. At least a portion of the cover is constructed of a material that is substantially transparent to visible light for allowing the ball to be viewed from outside said space. The display case also has a pedestal for supporting a bottom of the ball. The elevation of the pedestal relative to the base is adjustable.

Another aspect of the invention is a tamper resistant ball display case. The display case has a base and a cover. The cover is securable to the base by moving the cover relative to the base from a first position in which the cover is engaged with the base and can be separated from the base without damaging any part of the case and a second position in which the cover is engaged with the base and cannot be non-destructively removed from the base without moving the cover relative to the base away from said second position. The cover and base at least partially enclose a space for holding the ball when the cover is secured to the base. The display case also has a lock adapted for selective application to at least one of the base and the cover such that the lock assumes a locking position in which the lock engages at least one of the cover and the base when the cover is in the second position in a manner that prevents non-destructive movement of the cover away from the second position to separate the cover from the base and that prevents non-destructive movement of the lock out of the locking position. The lock is thus adapted for selectively and irreversibly converting the display case from an unlocked condition in which the cover is releasably secured to the base to a locked condition in which the cover cannot be non-destructively removed from the base.

Another aspect of the invention is a lock for a ball display case. The lock includes a plate having a plurality of recessed areas spaced radially about the plate. A plurality of posts extend away from the plate in a direction generally perpendicular to the plate. Each post is in general radial alignment with one of the recessed areas of the plate and spaced radially inward from the recessed area.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION

An exemplary embodiment of a display case of the present invention, generally designated 101, is illustrated in FIGS. 1-8 as a baseball display case, which is adapted to display a baseball 11. It is understood, however, that display cases of the present invention can display other kinds of sports memorabilia, including golf balls, basketballs, footballs, tennis balls, soccer balls, and the like.

Figure 2A:
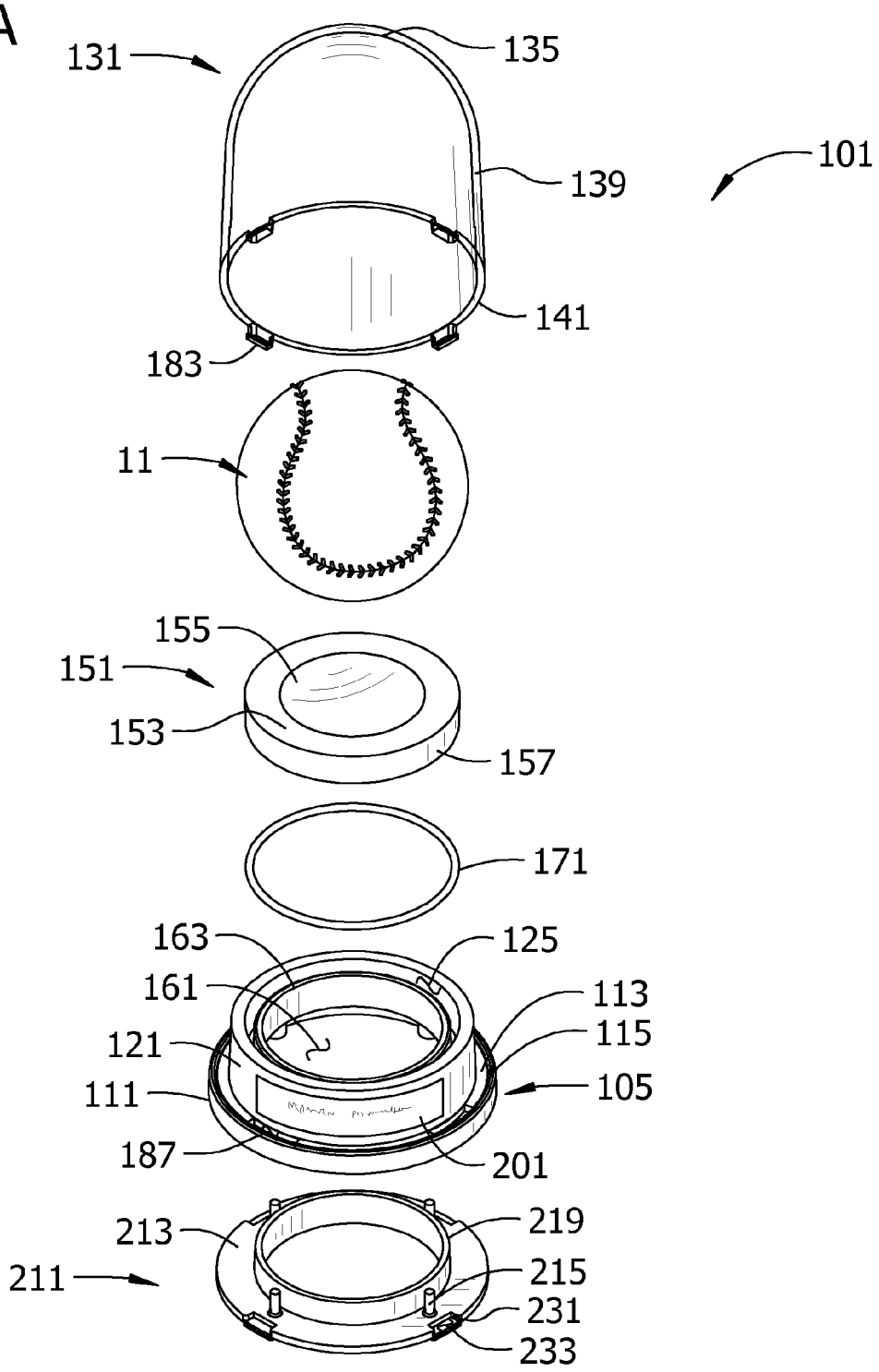
FIG. 2A is an exploded top perspective of the ball display case.
Figure 2B:
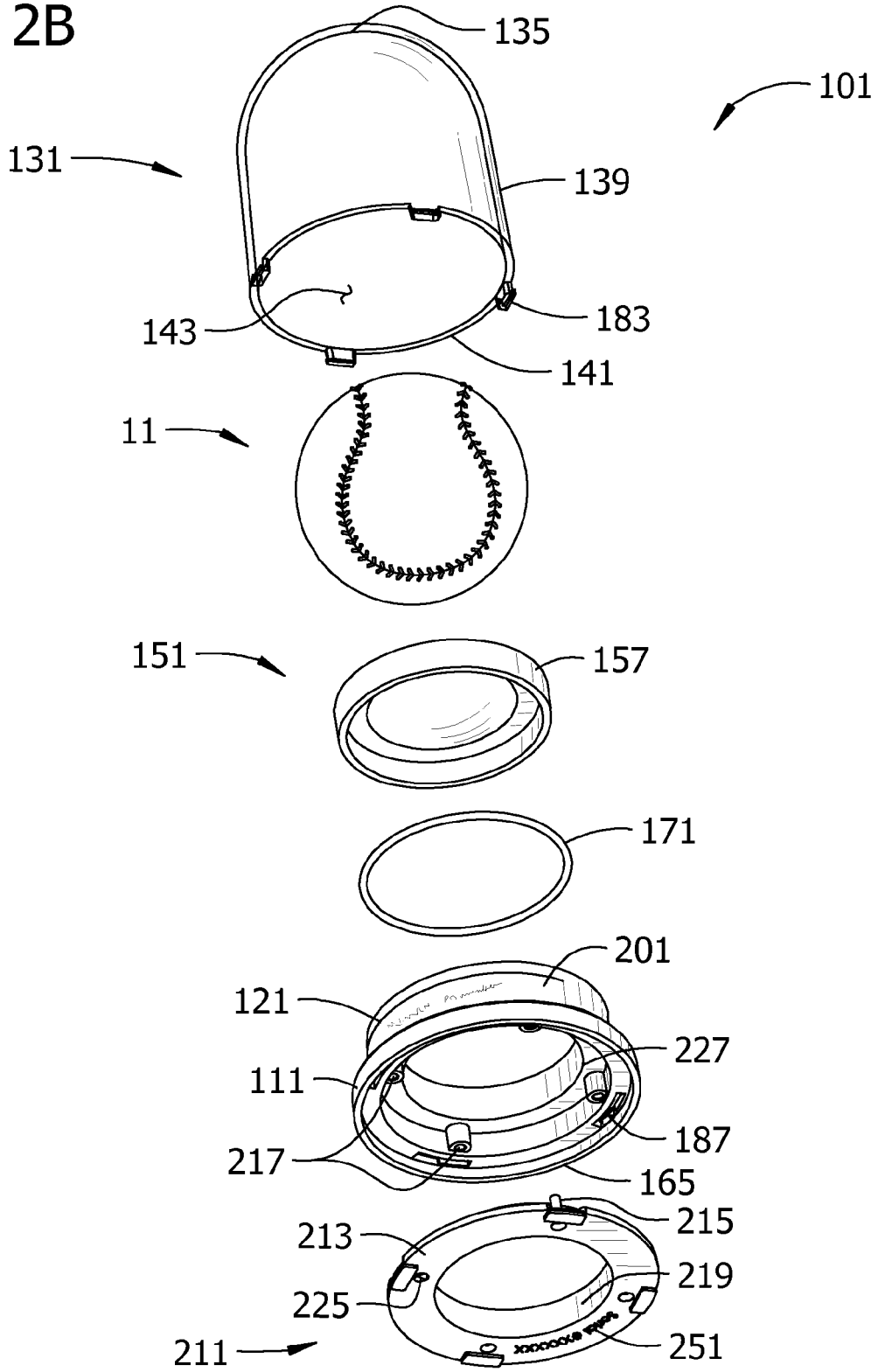
FIG. 2B is an exploded bottom perspective of the ball display case.
Figure 3A:
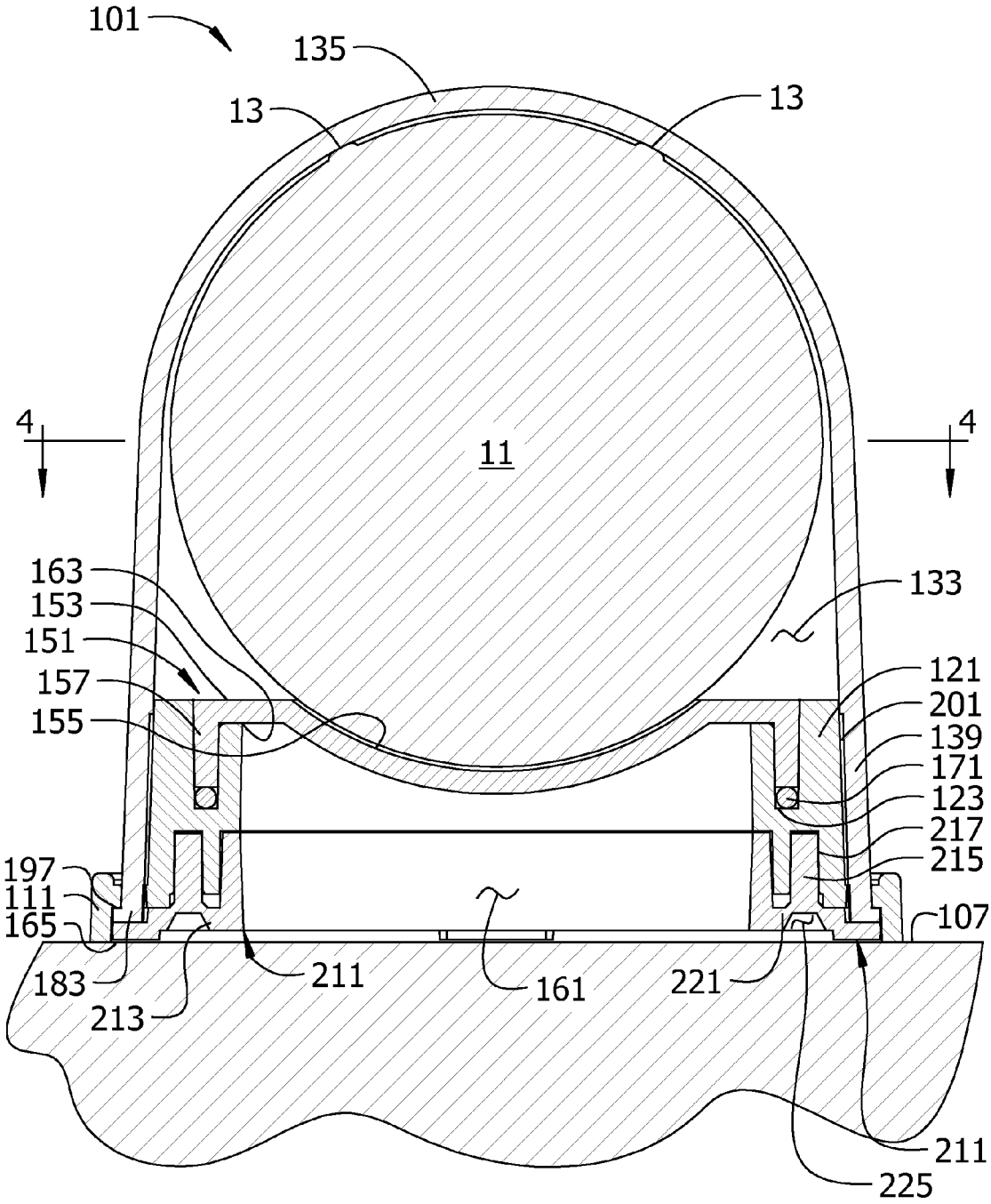
FIG. 3A is a cross section of the display case and baseball taken in a plane including line 3A-3A in FIG. 1.

Referring to FIGS. 2A-2B and 3A-3B, the display case 101 comprises a base 105 for supporting the case on a surface 107 (e.g., a table, shelf, or the like), as shown in FIG. 3A. In the illustrated embodiment, the base 105 is widest at its bottom. A lower sidewall 111 extends up from the bottom of the base 105. The lower sidewall 111 of the base is suitably generally cylindrical or frusto-conical with a slight (e.g., about 2 degrees) taper inward as it extends up from the bottom of the base. The base 105 also has a generally upwardly facing shoulder 113 (e.g., an annular shoulder) extending inward from the perimeter of the base at the top of the lower sidewall 111 (see FIGS. 2A and 3B). The top of the lower sidewall 111 suitably extends slightly above the shoulder 113 to form a retaining lip 115 extending around the perimeter of the shoulder. The base 105 also has an upper sidewall 121 extending generally upwardly from the inner margin of the shoulder 113. The upper sidewall 121 is suitably generally cylindrical or frusto-conical with a slight (e.g., about 2 degree) taper inward as it extends up from the shoulder 113.

The footprint of the upper sidewall 121 (i.e., the shape of the outline of the upper sidewall when viewed from the top) is suitably sized and shaped to be contained substantially within the inner margin of the shoulder 113. For example, in the illustrated embodiment, in which the sidewalls 111, 121 have substantially circular cross sections and in which the inner margin of the shoulder 113 is substantially circular, the largest diameter D1 (FIG. 4) of the upper sidewall is smaller than the smallest diameter D2 of the lower sidewall. The largest diameter D1 of the upper sidewall is also no larger than the diameter D3 of the inner margin of the annular shoulder 113.

The base 105 is suitably a unitary piece, as illustrated, and can be made of a relatively tough impact resistant material, such as Polycarbonate, ABS, or Acrylic, to limit the risk of accidentally breaking the base. A suitable base can be made using commercially available injection molding technology.

Referring again to FIGS. 1 and 2A-2B, the display case 101 also includes a protective cover 131 that can be supported by the base 105. When the cover 131 is on the base 105, the cover and base at least partially enclose a space 133 (FIG. 3A) sized and shaped for containing the ball 11. The cover 131 in the illustrated embodiment has a dome-shaped top 135 (e.g., a substantially hemispherical top) and a peripheral sidewall 139 (e.g., a substantially cylindrical or frusto-conical sidewall having a circular cross section) extending down from the top of the cover. The bottom edge 141 of the sidewall 139 defines an open end 143 of the cover 131 and is suitably sized and shaped to engage and be supported by the shoulder 113 of the base 105 when the cover is on the base. For example, in the illustrated embodiment in which the shoulder 113 has a circular shape, the lower edge 141 of the cover 131 has circular shape corresponding to the circular shape of the shoulder. The retaining lip 115 on the base 105 also extends around the lower end 141 of the sidewall 139 of the cover 131 when the cover is on the base.

The cover 131 (or at least a portion thereof) is suitably substantially transparent to visible light. This allows the ball 11 or other object in the display case 101 to be viewed through the cover 131 by someone outside the space 133. In the illustrated embodiment, the ball 11 is viewable through the sidewall 139 of the cover 131 from any direction (i.e., at any angle over a 360 degree range) because the entire sidewall is substantially transparent to visible light. The ball 11 is also viewable through the top 135 of the cover 131 in the illustrated embodiment because the top is also substantially transparent to visible light.

The cover 131 is suitably relatively less transparent to ultraviolet and/or infrared light than it is to visible light. For example, the cover 131 suitably blocks from at least about 70 percent to about 99.9% of UVA radiation (wavelengths in the range of 320 nm to 400 nm). One example of a suitable material that provides UV protection is Acrylite® 8N which is commercially available from Evonik CYRO LLC of Parsippany, N.J. One or more additives can suitably added to the material used to make the cover 131 to protect the ball 11 from infrared radiation. Suitable materials including additives that provide infrared protection are commercially available from Evonik CYRO LLC of Parsippany, N.J. Protecting the ball 11 from exposure to ultraviolet and/or infrared radiation in this manner can reduce degradation of the ball 11 that could be caused by these types of radiation.

The cover 131 is suitably made from a relatively tough impact resistant material to limit the risk of accidentally breaking the cover. Although the cover 131 can be made from various different materials within the scope of the invention, some materials that are suitable for the cover include Acrylic and Polycarbonate. A suitable cover can be molded as a unitary structure using commercially available injection molding processes.

As best understood in reference to FIGS. 2A, 3A, and 5A-5C, the base 105 supports a pedestal 151 having a surface 153 disposed to support the ball 11 in the display case 101. In the illustrated embodiment, an indentation 155 in the support surface 153 of the pedestal 151 is shaped so a portion of the support surface generally conforms to the shape of the ball 11. In the case of a generally spherical ball 11, for example, the indentation 155 is suitably generally spherical and curved on a radius that is about the same as the radius of the ball, as illustrated in FIG. 3A. If the item displayed in the case is an American football or other non-spherical item, the shape of the indentation can suitably be changed to match the shape of the item. The indentation 155 facilitates positioning the ball 11 on the pedestal 151. For example, the indentation 155 automatically centers the ball 11 on the pedestal 151. The indentation 155 also makes it less likely that the ball 11 will accidentally fall off the pedestal 151 (e.g., before the cover 131 is secured to the base 105). Further, the indentation 155 facilitates distribution of the forces supporting the ball 11 over a wider area of the ball. This can help preserve the condition of the ball 11.

In the illustrated embodiment, the base 105 has a hollow center 161 (FIG. 3A) extending between open ends 163, 165 at the top and bottom of the base 105, respectively. In this embodiment, the pedestal 151 extends over the open end 163 at the top of the base 105 and operates in conjunction with the base and cover 131 to enclose the ball 111 in the display case 101. The pedestal 151 is suitably made from a material that is substantially transparent to visible light, which allows the bottom of the ball 11 to be viewed through the hollow center 161 of the base 105. However, the base can be constructed to have a wall or other structure closing the open end at the top of the base (or disposed elsewhere in the base) such that the pedestal is enclosed in the case with the ball by the base and cover. The pedestal 151 in the illustrated embodiment is a separate piece from the base 105 for reasons that will become apparent. It is understood, however, that a pedestal may be constructed as a unitary structure with the base within the scope of the invention. A suitable pedestal can be made of Polycarbonate, ABS, Acrylic or the like using commercially available injection molding technology. Further, the same materials describe above that can be used to make the cover 131 so it protects against ultraviolet and/or infrared radiation can be used to make a substantially transparent pedestal that protects against ultraviolet and/or infrared radiation.

In the illustrated embodiment, the elevation of the pedestal 151 (particularly the support surface 153 thereof) relative to the base 105 is adjustable. Balls (even when they are the same type) can vary slightly in size. For example, a ball may shrink slightly over an extended period of time as gases are slowly released from the ball. If the ball 11 to be displayed in the case 101 is slightly smaller than a "normal" ball, such as might be the case with an older ball, the elevation of the pedestal 151 (and therefore the elevation of the ball) is suitably raised so the ball extends up from the pedestal to contact the top 135 of the cover 131, which is suitably shaped to conform to the shape of the ball. In particular, the elevation of the pedestal 151 is suitably adjusted so the ball 11 is very lightly compressed between the cover 131 and the pedestal to inhibit shifting or rattling of the ball in the case 101. If the ball 11 is too large, the elevation of the pedestal 151 is lowered to reduce compression of the ball between the cover 131 and the pedestal.

Because the indentation 155 in the pedestal 151 and the inner surface of the cover 131 at the top 135 are both shaped to generally conform to the outer surface of the ball 11, the light compressive forces are suitably distributed over a large area of the ball. In the case of a baseball 11, for example, the pedestal 151 and cover 131 contact relatively broad areas of the ball at the raised seams 13 instead of subjecting the ball to concentrated forces at only a few different points. Light compression of the ball 11 between the cover 131 and pedestal 151 limits the ability of the ball 11 to rattle in the space 133 between pedestal and cover. This can help preserve the condition of the ball. The light compression also limits the ability of the ball to rotate in the case 101 and makes it more likely that the ball will be maintained in a desired orientation, such as one in which an autograph or other feature of interest is displayed prominently.

Figure 5A:
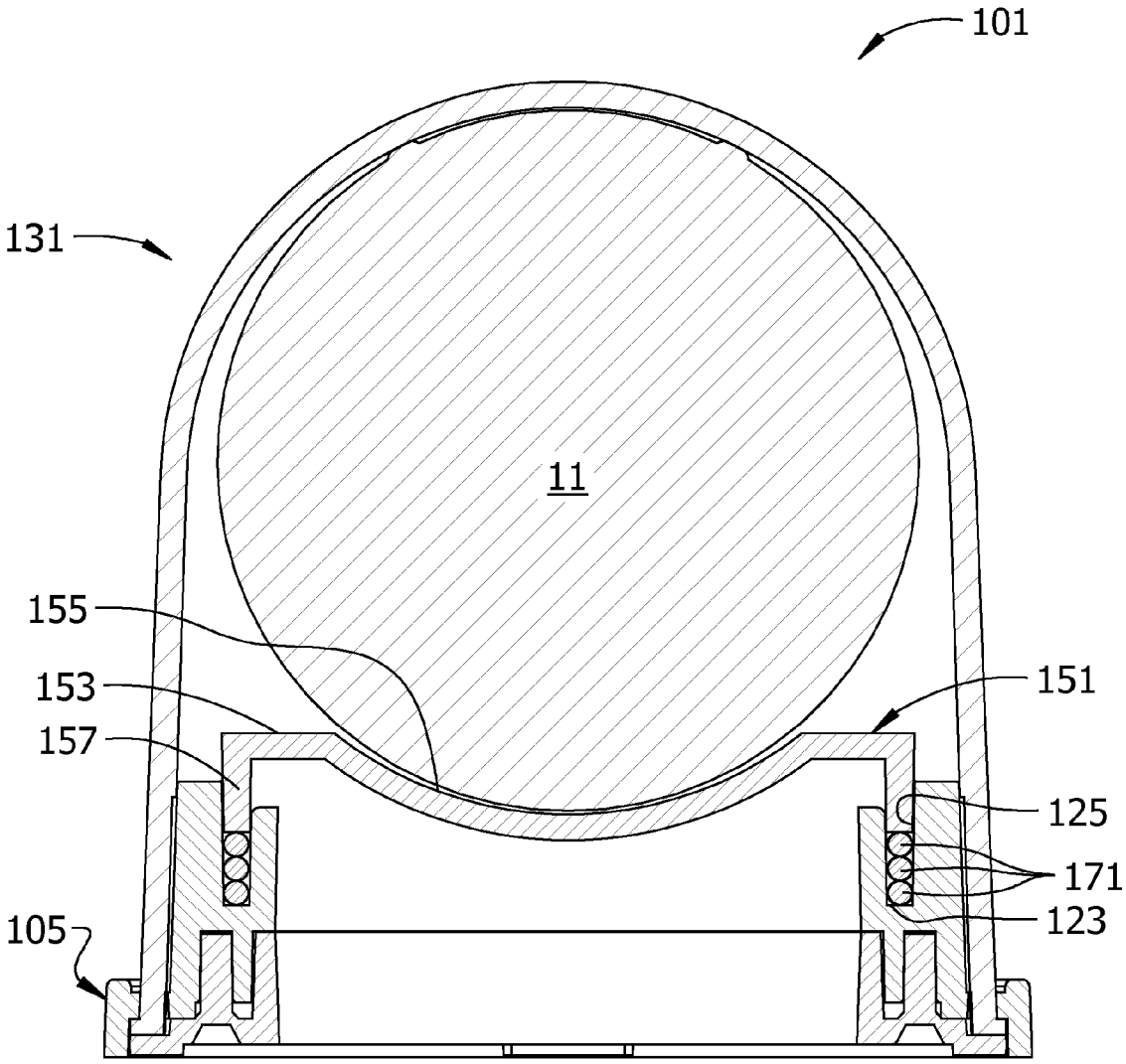
FIGS. 5A-5C are cross sections of the display case similar to FIG. 3A illustrating adjustment to the elevation of a pedestal used to support the ball.
Figure 5B:
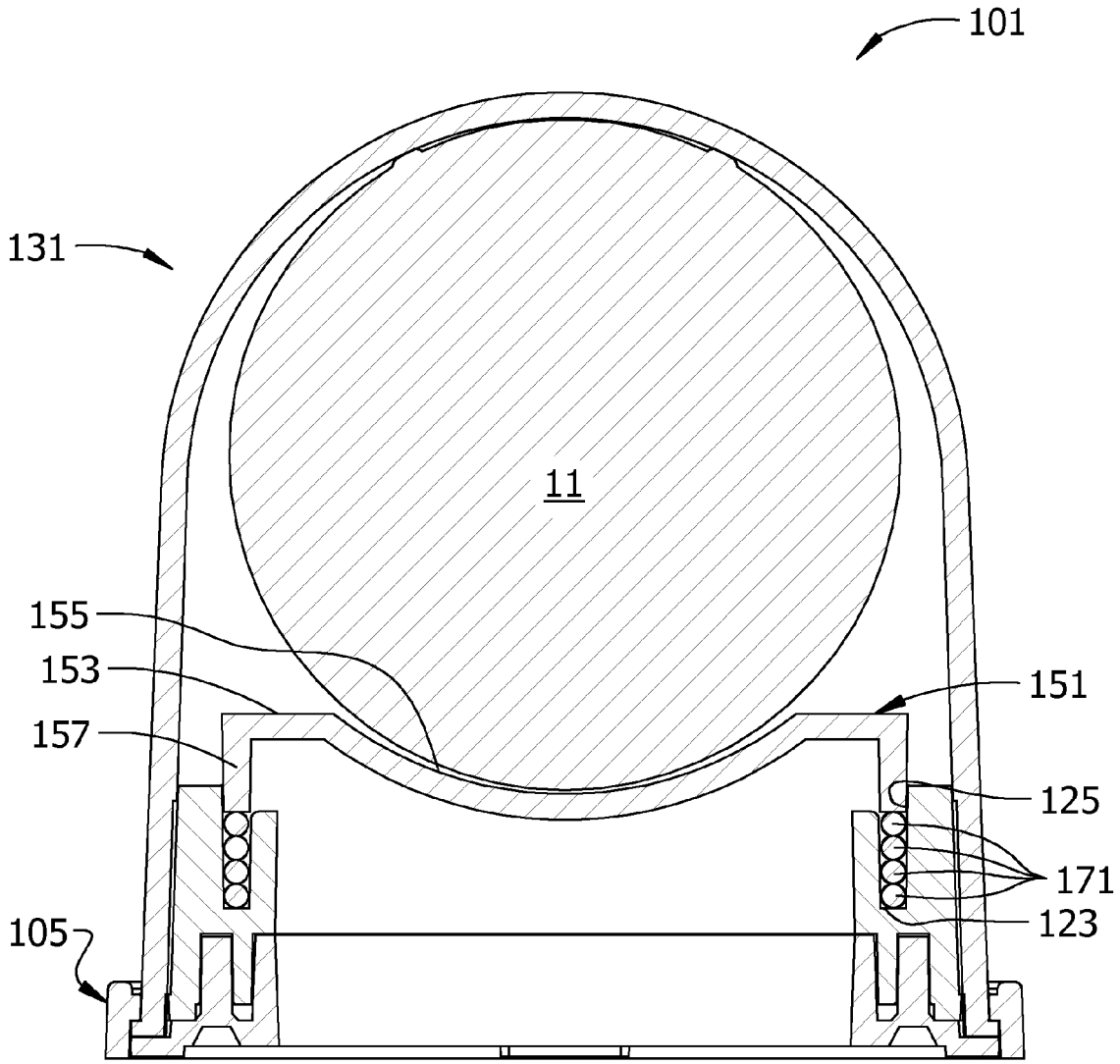
Figure 5C:
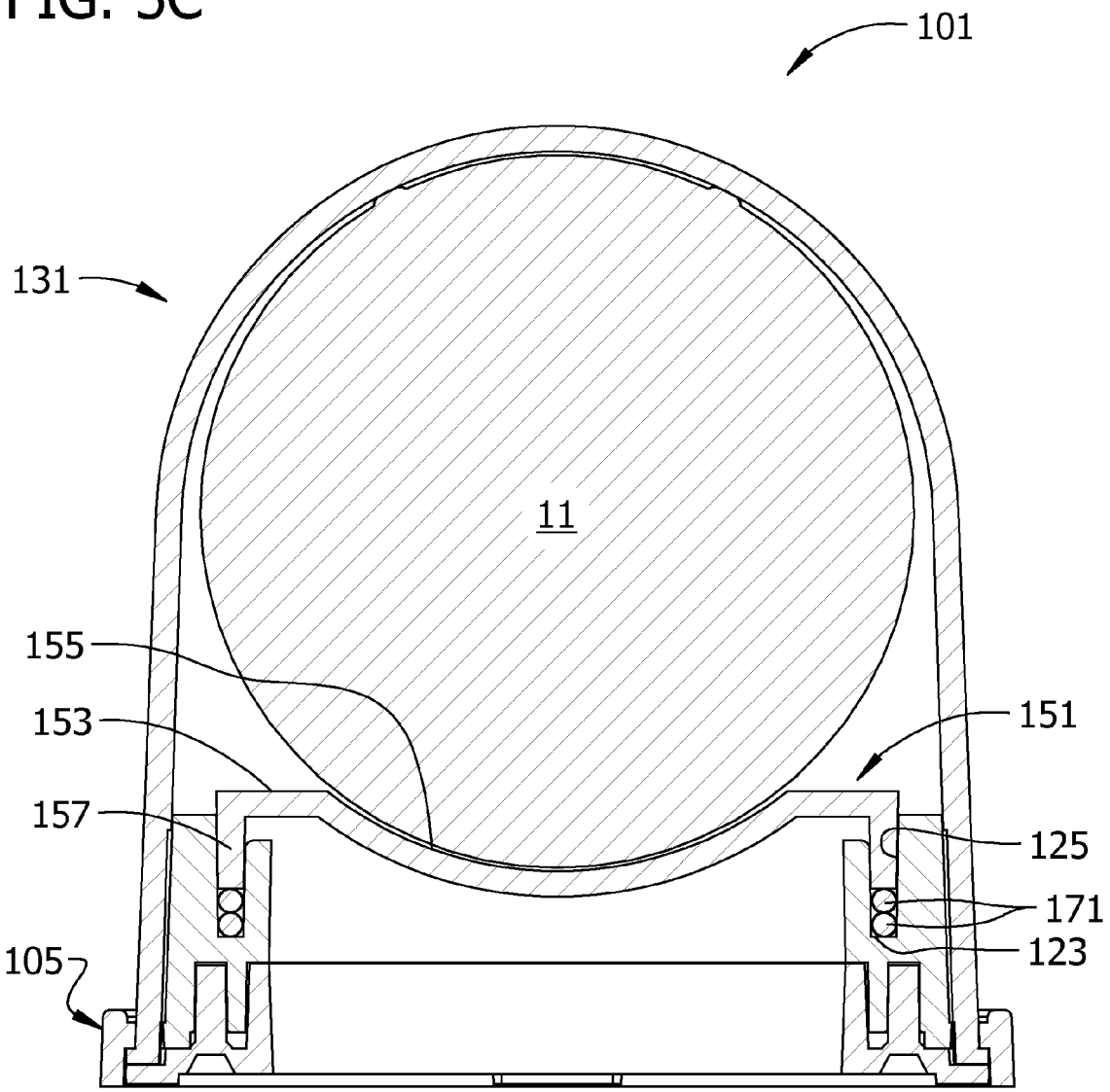

There are various ways to make a display case in which the elevation of a pedestal is adjustable. Referring to FIGS. 5A-5C, for example, the pedestal 151 has a peripheral sidewall 157 extending down from the top of the pedestal. The base 105 has an upward facing pedestal support surface 123 positioned to support the end of the pedestal sidewall 157. The support surface 123 of the base 105 is at the bottom of a groove 125 (e.g., a substantially circular groove) in the base extending around the perimeter of the open top 163 of the base and configured so at least a portion of the pedestal sidewall 157 can be received in the groove. The pedestal sidewall 157 can slide up and down in the groove 125 relative to the base 105. The elevation of the pedestal 151 relative to the base changes as the pedestal slides up and down in the groove 125.

One or more spacers 171 (e.g., O-rings) are suitably positioned in the groove 125 to support the pedestal 151 at a desired elevation. For example, in FIG. 5A a stack of two O-rings 171 are positioned in the groove 125 (e.g., at the bottom of the groove) to support the pedestal 151 above the support surface 123 at the bottom of the groove 125. One or more O-rings 171 can be added to the stack (as indicated in FIG. 5B) to raise the pedestal 151. Conversely, one or more O-rings 171 can be removed from the stack (as indicated in FIG. 5C) to lower the pedestal until the pedestal contacts the base 105 (either at the pedestal support surface 123 or elsewhere on the base if the pedestal sidewall 157 is too short to reach all the way to the bottom of the groove 125). The spacers 171 are suitably made of silicon, Neoprene, or another resiliently compressible material.

Although the spacers 171 in the drawings extend in a continuous circle all the way around the groove 125, a spacer does not necessarily need to extend all the way around the groove. For example, a suitable "O-ring" can be made on the spot if necessary by simply laying a strand of rubber cord in the groove 125, in which case there may be a gap between the ends of the rubber cord. One advantage of using rubber cord to make any spacers that are needed is that a supply of rubber cord provides the flexibility to make spacers having various different sizes and shapes. This makes it unnecessary to maintain supplies of multiple different kinds of spacers to use with different kinds of display cases. Spacers other than O-rings and rubber cord can also be used within the scope of the invention.

Figure 6A:
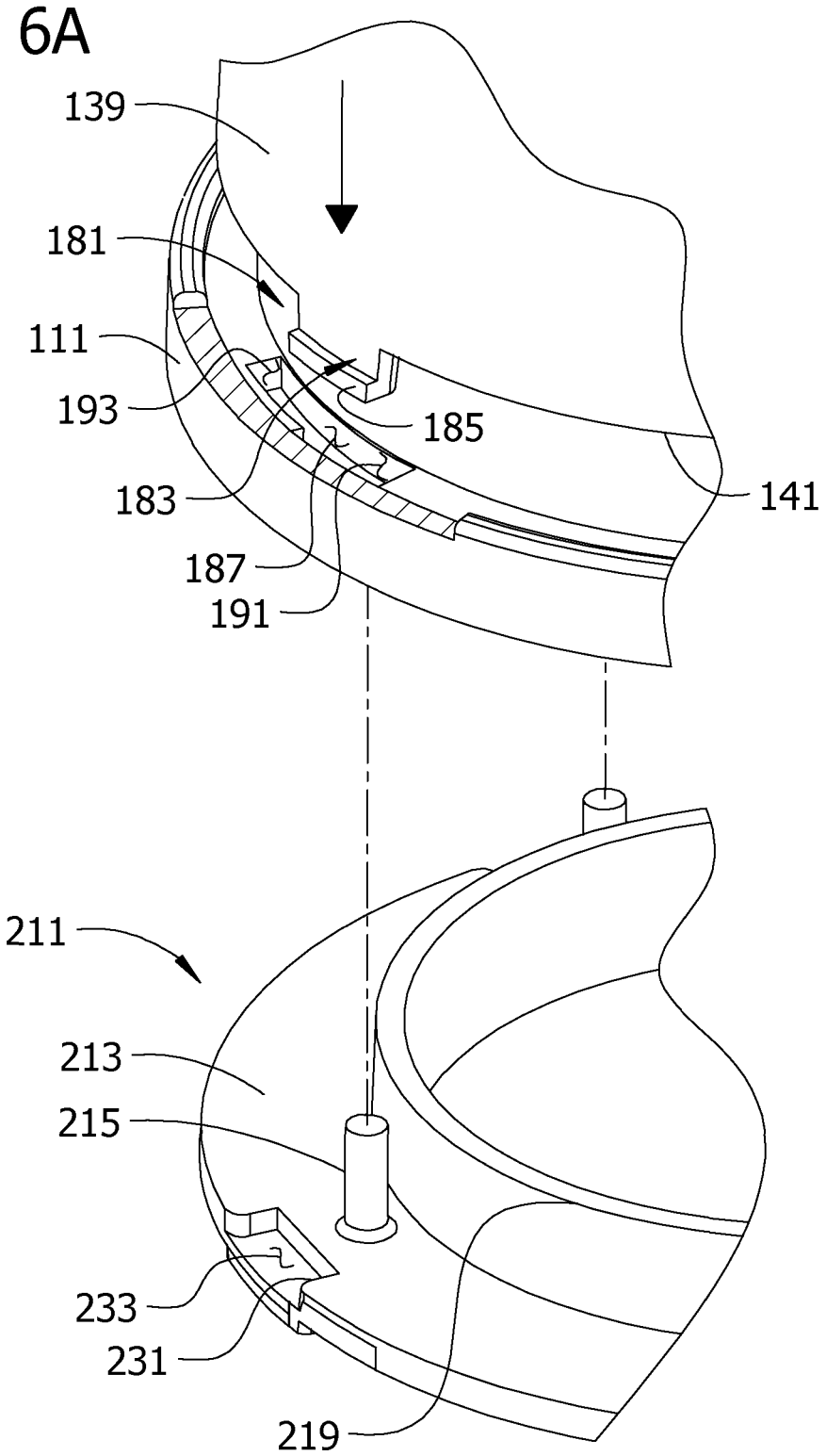
FIGS. 6A-6D are enlarged perspectives of a portion of the ball display case illustrating operation of a bayonet connection to secure a cover to a base of the display case.
Figure 6B:
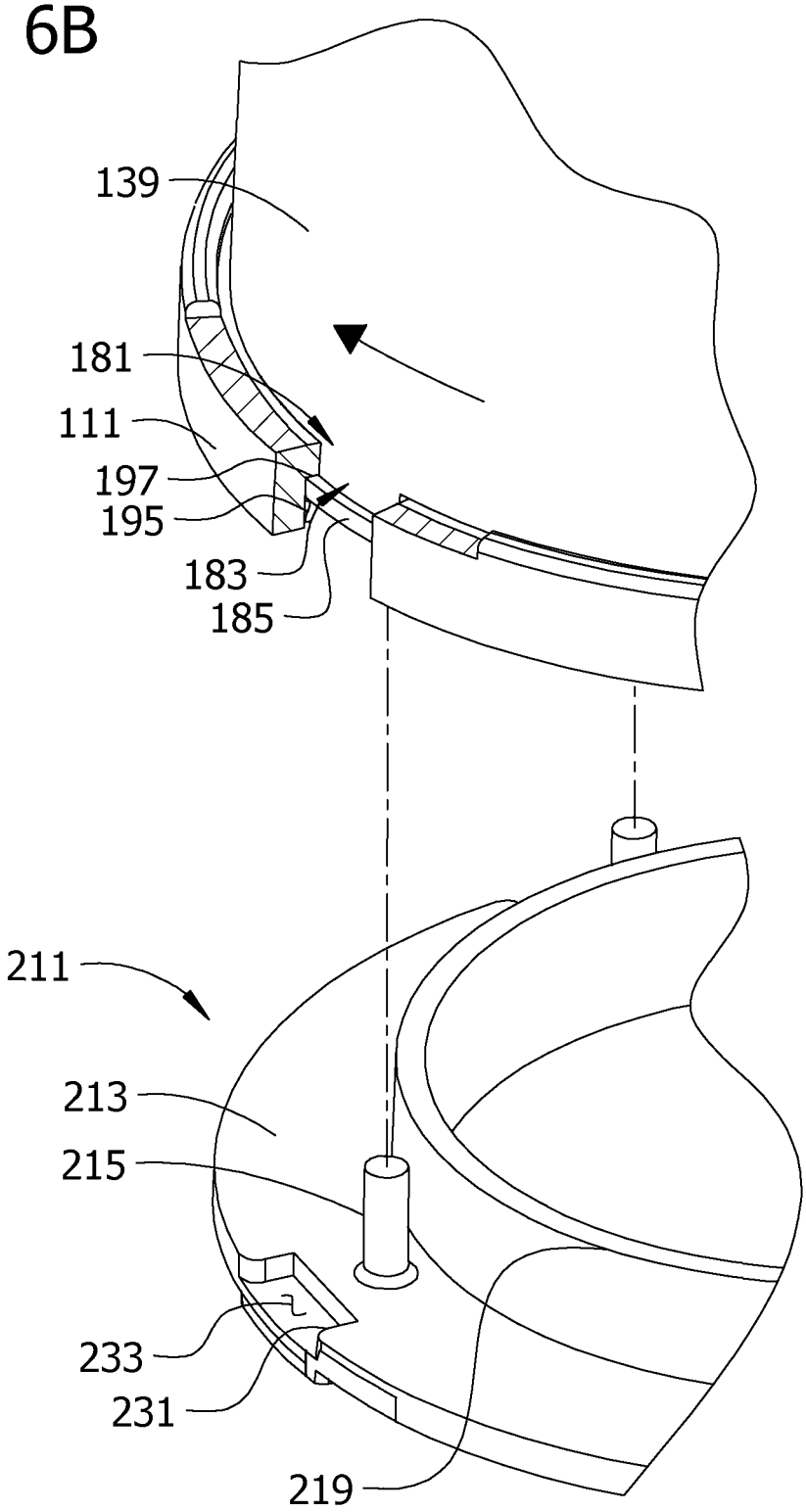
Figure 6C:
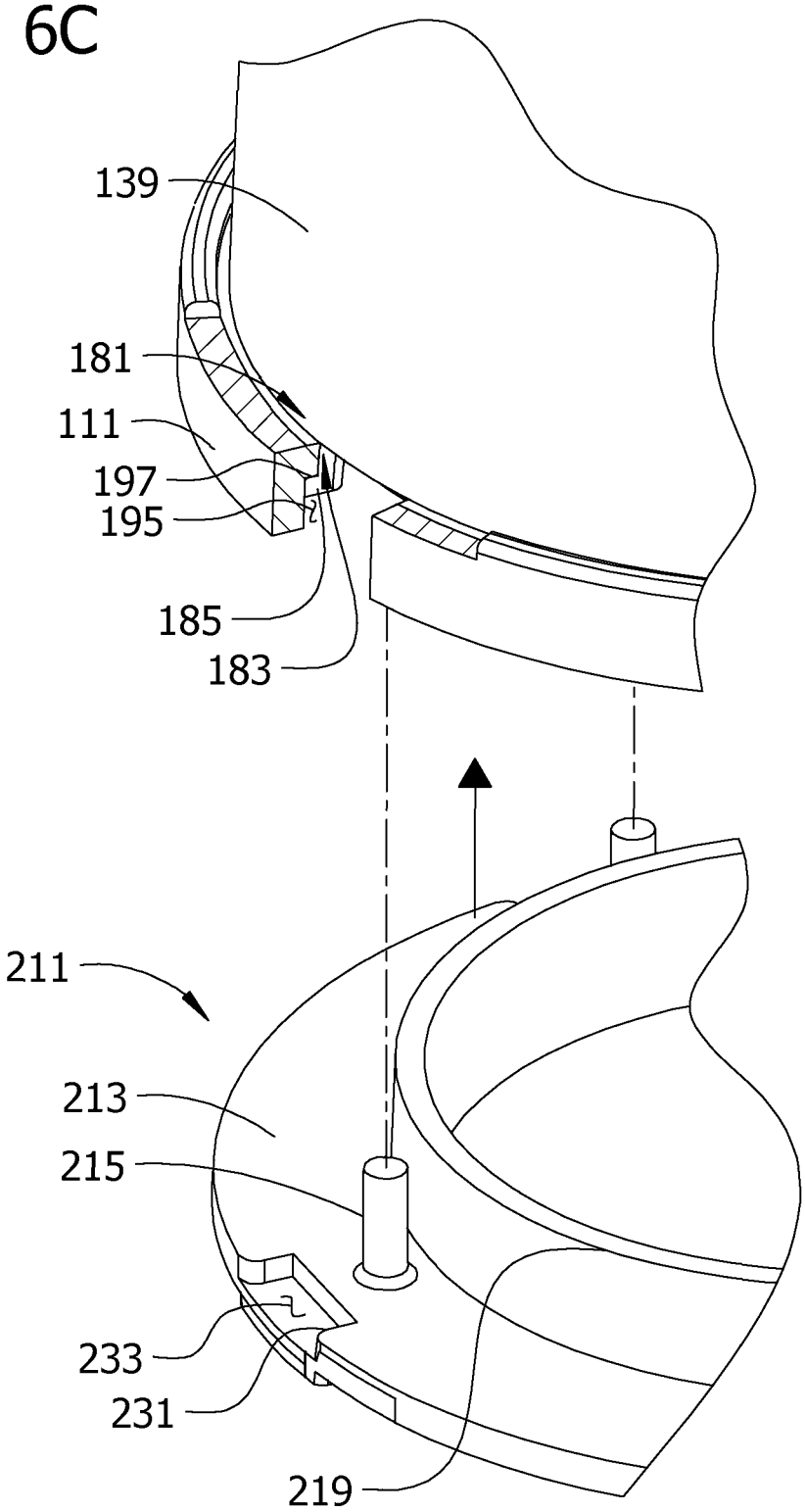

The cover 131 is suitably securable to the base 105 (e.g., to the shoulder 113) to hold the cover on the base. For example, a bayonet connection 181 can suitably be used to secure the cover 131 to the base 105. As best illustrated in FIGS. 6A-6C, a plurality of lugs 183 (e.g., four lugs) extend down from the lower end 141 of the cover's sidewall 139. Each lug 183 has a laterally extending projection 185 (which is a radially extending flange in the illustrated embodiment) spaced from the bottom edge 141 of the cover sidewall 139. A plurality of openings 187 (e.g., arcuate slots) in the shoulder 113 are arranged to receive the lugs 183. Each opening 187 has a relatively wider portion 191 and a relatively narrower portion 193 adjacent the wider portion.

The wider portions 191 of the openings 187 provide sufficient clearance for each of the lugs 183 to be inserted into a respective one of the openings when the cover 131 is moved into engagement with the base 105, as illustrated in FIGS. 6A-6B. The cover 131 is moveable (e.g., rotatable) relative to the base 105 such that after the lugs 183 have been inserted into the relatively wider portions 191 of the openings 187, the cover can be moved relative to the base 105 to move the lugs into the narrower portions 193 of the openings (FIGS. 6B and 6C). As the lugs 183 move into the relatively narrower portions 193 of the openings 187, the projections 185 enter a space 195 in the base 105 extending under a downward facing surface 197 of the base adjacent the opening 187.

There is insufficient clearance in the relatively narrower portions 193 of the openings 187 for the lugs 183 to be withdrawn from the openings through the narrower portions.

In the illustrated embodiment, for example, when the cover 131 is secured to the base 105 by the bayonet connection 181 and a lifting force is applied to the cover, the radially extending flanges 185 engage the downward facing surfaces 197 (FIG. 6C) of the base 105 which thereby retain the lugs 183 in the openings. Accordingly, when the lugs 183 are in the narrower portions 193 of the openings 187, the cover 131 is retained in position relative to the base 105. In order to remove the cover 131 from the base 105 once it has been secured in this manner without destroying the lugs 183 and/or the edge margins of the openings 187, the cover has to be rotated relative to the base to move the lugs back into the relatively wider portions 193 of the openings before lifting the cover off the base.

Figure 1:
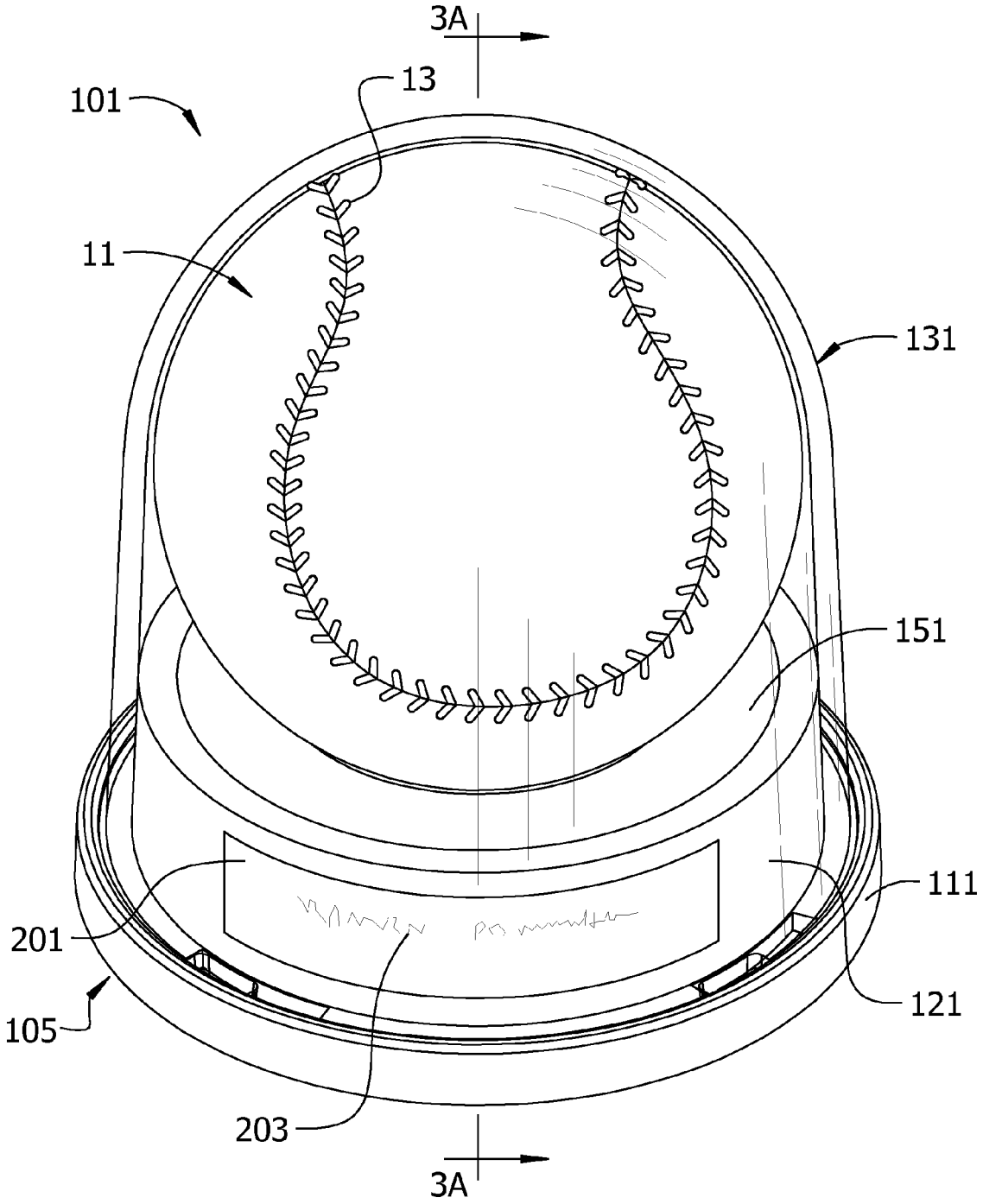
FIG. 1 is a perspective of an exemplary embodiment of a ball display case displaying a baseball.
Figure 4:
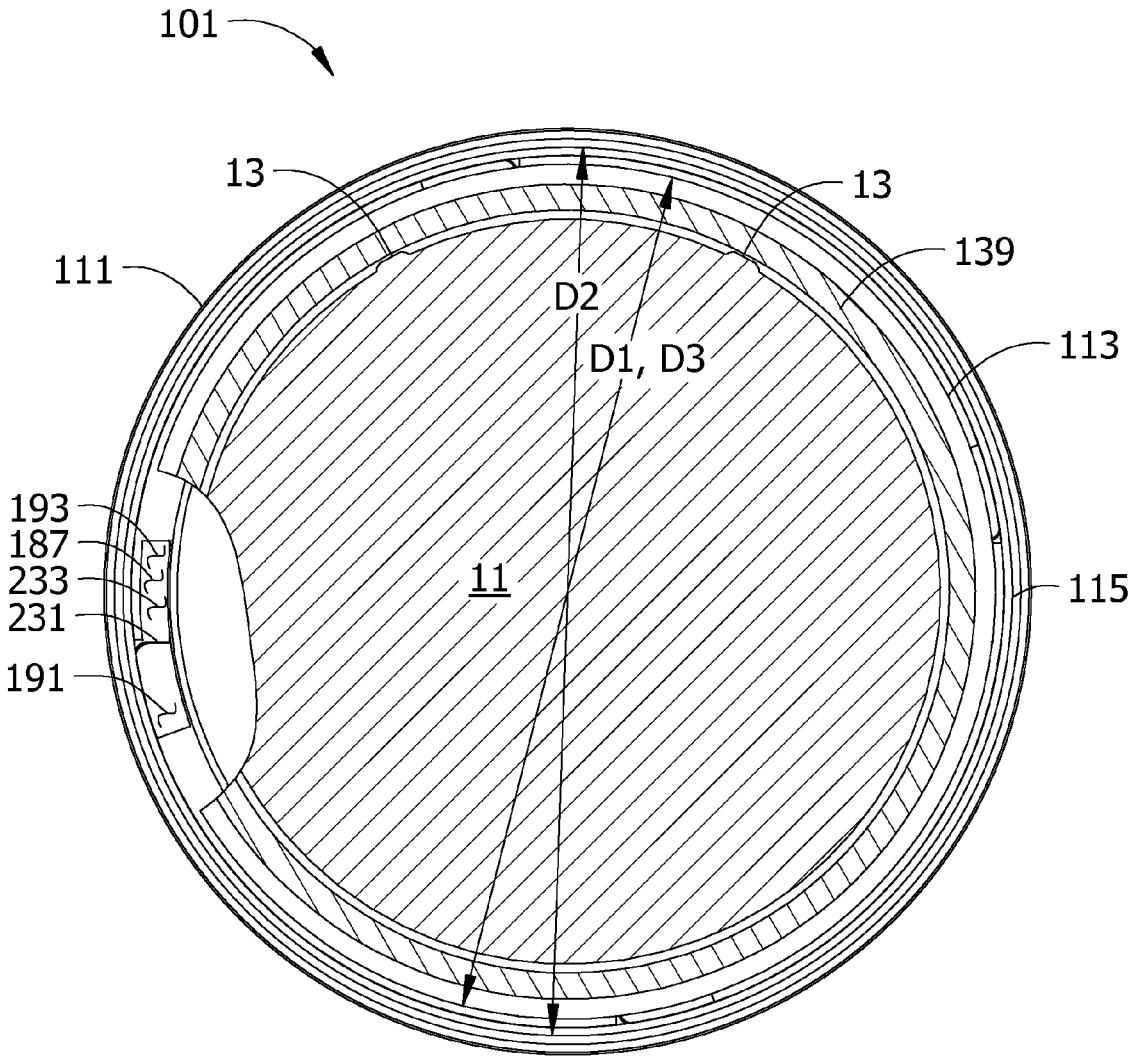
FIG. 4 is a cross section of the display case taken in a plane including line 4-4 on FIG. 3A in which a portion of the display case has been removed to illustrate features that would be obscured otherwise.

When the cover 131 is on the base 105, it suitably limits access to the ball 11 (when there is a ball in the display case 101), the pedestal 151, and the upper sidewall 121 of the base. As illustrated in FIGS. 1, 3A, and 4, for example, the cover 131 suitably extends substantially continuously around all sides and over the top of the ball 11 (or the space 133 for containing the ball if the display is empty). Further, when the ball 11 is in the space 133 between the pedestal 151 and the cover 131, the pedestal and base 105 limit access to the ball through the open end 143 of the cover. The space 133 for containing the ball 11 is suitably not hermetically sealed to allow venting (e.g., to allow escape of any gases released from the ball) and to make the display case 101 less susceptible to formation of condensation in the space that holds the ball 11. However, the ball 11 is well protected from physical damage and cannot be removed from the space 133 without taking the cover 131 off the base 105.

In some cases, there is a relatively low risk of theft or fraud involving the ball 11 and additional security precautions may be unnecessary. In these cases, the display case 101 can be maintained indefinitely in a condition in which the cover 131 is releasably secured to the base 105 so the ball 11 can be taken out of the display case and replaced in the display case. However, in other cases it may be desirable to limit the ability to remove of the ball 11 from the display case 101 once it is enclosed therein in order to combat theft and/or fraud.

The case 101 illustrated in the drawings includes a tamper-resistant irreversible lock 211 (FIG. 2A) that can be selectively applied to convert the display case 101 from an unlocked condition (see FIG. 6C) in which the cover 131 is releasably secured to the base 105 to a locked condition (see FIGS. 6D and 7) in which it is difficult (if not impossible) to achieve non-destructive removal or separation of the cover from the base. In other words, if the lock 211 is omitted or if the lock has not yet been applied, the cover 131 can be removed from and re-secured to the base 105 numerous times without any significant damage. Once the irreversible lock 211 has been applied, however, it is difficult (if not impossible) to remove the ball 11 from the display case 101 without destroying one or more parts of the display case and/or leaving evidence that the ball may have been tampered with or replaced with a different ball (e.g., one having a forged autograph).

Figure 6D:
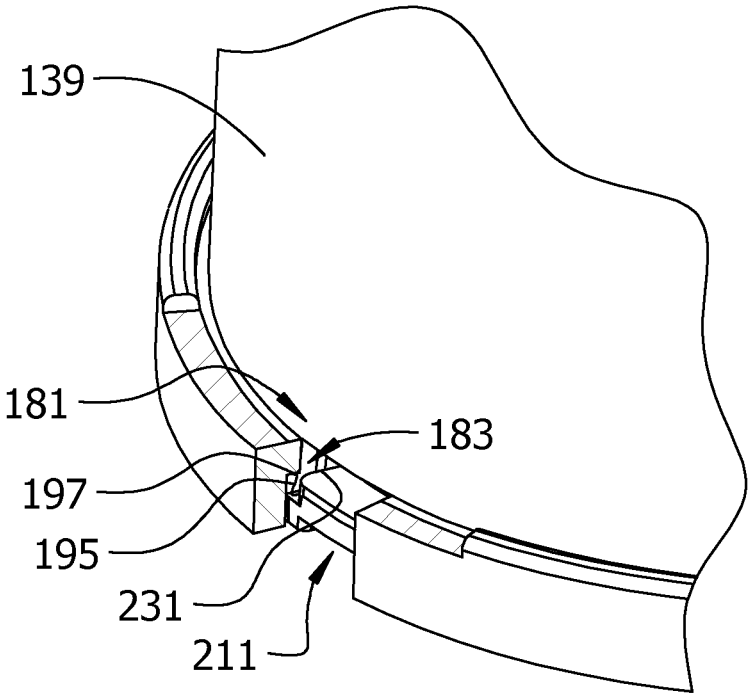
Figure 7:
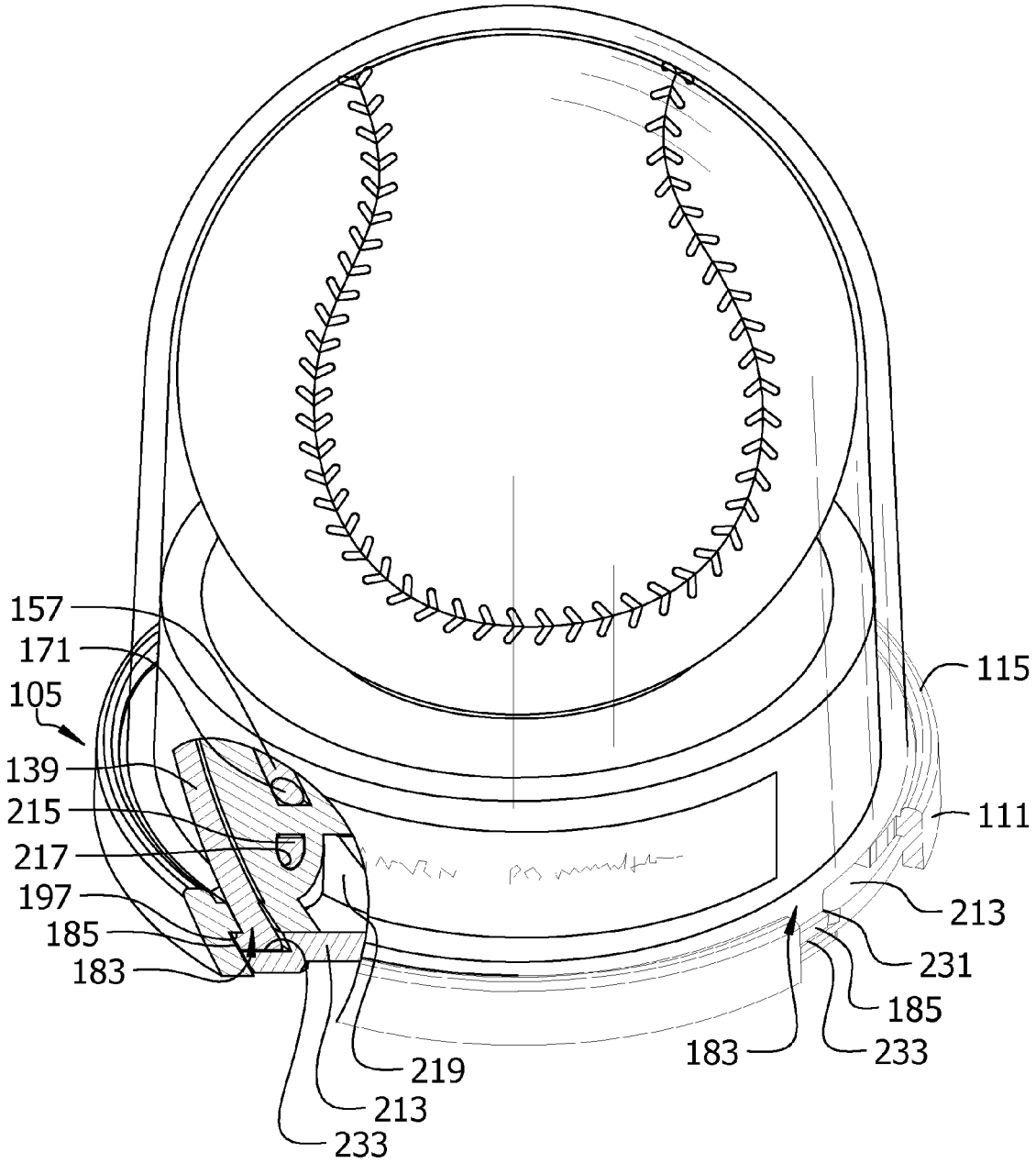
FIG. 7 is a perspective the display case in which portions of the case have been broken away to show internal features of the display case.

Referring to FIGS. 6D and 7, for example, the lock 211 in the illustrated embodiment can be applied to the case 101 to prevent movement of the cover 131 relative to the base 105 in the manner required to release the connection between the cover and the base. For example, the lock 211 suitably engages the cover 131 and the base 105 in a manner that prevents rotation of either the cover or base relative to the lock. Consequently, the rotation of the cover 131 relative to the base 105 that would be required to release the bayonet connection 181 is prevented. Further, the lock 211 is secured to at least one of the cover 131 and base 105 in a manner that makes it difficult (if not impossible) to remove the lock without deforming or breaking one or more parts of the case 101 in a way that leaves evidence of the fact that the lock has been removed.

Figure 3B:
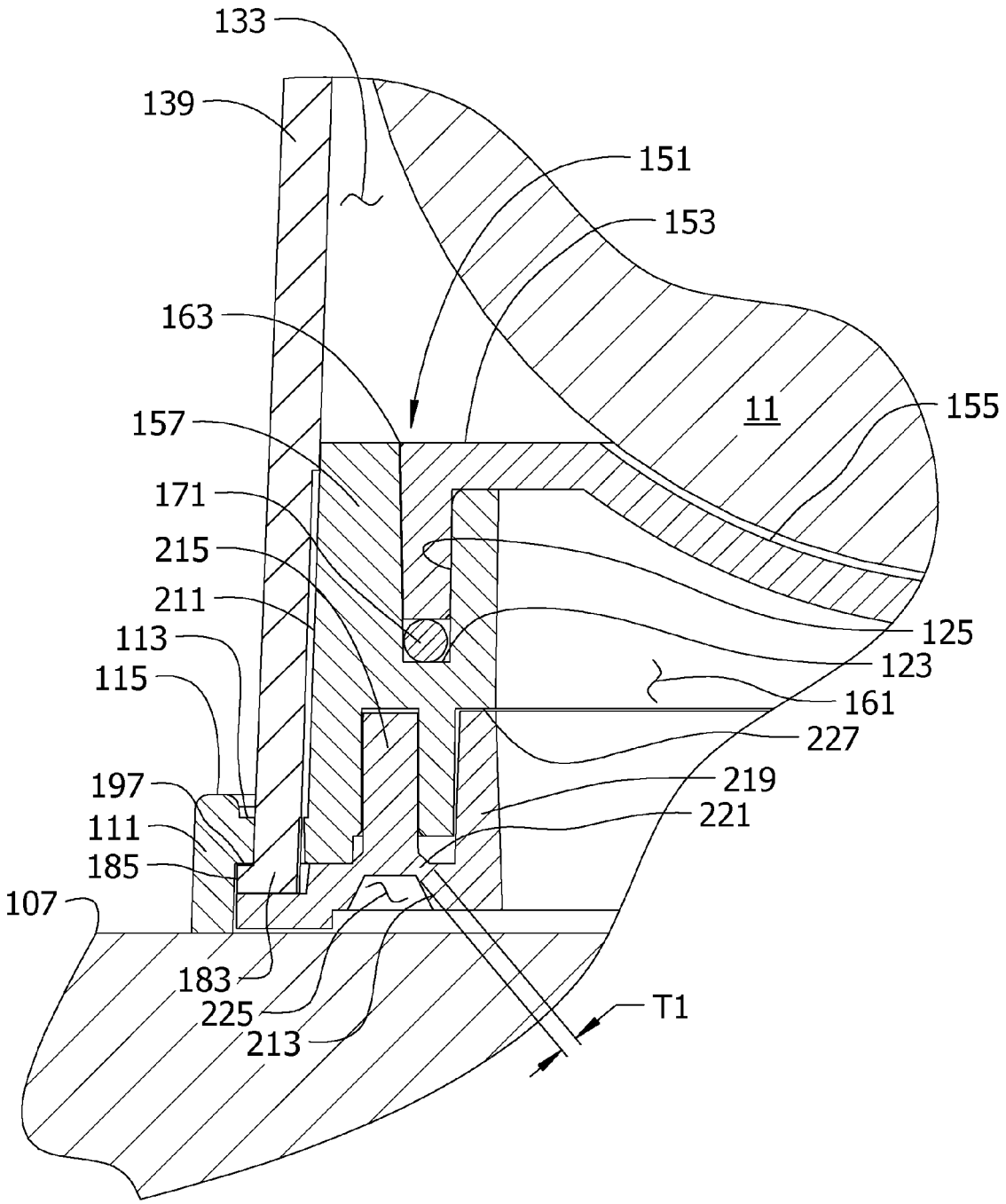
FIG. 3B is an enlarged cross section of a portion of the display case as illustrated in FIG. 3A.

As illustrated in FIGS. 3A-3B, and 7, the lock 211 suitably includes a plate 213 (broadly a "body") sized and shaped to be received in the open end 165 at the bottom of the base 105. A plurality of posts 215 (e.g., four posts as illustrated) extend up from the plate 213. As illustrated in FIG. 2B, the base 105 has a plurality of openings 217 (e.g., holes) arranged so each of the posts 215 can be received in a respective one of the openings. When the posts 215 are in the openings 217, the posts hold the lock 211 and base 105 in a substantially fixed rotational orientation relative to one another, as best understood in reference to FIGS. 3A and 7.

The case 101 is constructed so the posts 215 cannot be withdrawn from the openings 217 without damaging one or more parts of the display case. For example, the lock 211 suitably lacks the structural strength to withstand the forces that would be required to withdraw the posts 215 from the openings 217, thereby resulting in the lock breaking if someone tries to remove if. There are several ways to ensure the posts 215 cannot be non-destructively withdrawn from the openings 217 in the base 105. One option is to ensure that a relatively strong force is required to withdraw the posts 215 from the openings 217. For example, an adhesive (e.g., Cyanoacrylate glue) can be used to glue the posts 215 into the openings 217. Also, one or more openings 217 can be constructed without any draft to increase the force required to withdraw the posts 215. If the base 105 is manufactured in an injection molding process, it may be desirable to design the mold so each of the openings 217 that has no draft is next to an ejection pin to limit complications associated with the lack of a draft during ejection of the base from the injection molding apparatus. The posts 215 can be dimensioned relative to the openings 217 so there is a slight interference fit to increase the force required to withdraw the posts. The amount of force required to withdraw the posts 215 can also be increased by using posts that have barbs (not shown) or other features commonly used to make various plastic "push-in fasteners" that are known in the art.

Another option that can be used by itself or in combination with features that increase the force required to withdraw the posts 215 from the openings 217 is to construct a part of the lock 211 so the lock can only withstand a limited amount of force. As illustrated in FIGS. 3A and 3B, for example, the lock 211 has one or more frangible portions 221 that facilitate at least portions of one or more posts 215 being broken away from the plate 213 and retained in the openings 217 (FIG. 8) when a force is applied to remove the lock 211. As illustrated in FIGS. 3A and 3B, frangible portions 221 connect each of the posts 215 to the plate 211 to facilitate breaking of the lock 211 generally at the bases of the posts 215. One or more frangible portions 221 can be made by constructing the plate to have a dimple 225 on the side of the plate 213 opposite the posts 215 and generally in registration with a respective one of the posts. In the illustrated embodiment, the plate 213 has a dimple 225 for each of the posts 215. Each dimple 225 results in the lock 211 having a reduced thickness T1 (FIG. 3B) at the base of the post 215 and thereby creates an annular thin-wall frangible portion 221 extending between the post 215 and the plate 213. Further, the frangible portions 221 can be inspected for signs of damage without removing the lock 211 from the display case by looking into the dimples 225. The lock can be constructed to have one or more different frangible portions within the scope of the invention. Any combination of features that increase the amount of force required to withdraw the posts 215 from the openings 217 and/or reduce the amount of force the posts can withstand can be used within the scope of the invention.

As best illustrated in FIGS. 2A and 6C-6D, the lock 211 also includes at least one stop 231 (e.g., four stops). When the lock 211 has been applied to the case 101, the stops 231 are positioned to block movement of the lugs 183 from the relatively narrower portions 193 of the openings 187 into the relatively wider portions 191 of the openings to prevent release of the cover 131 from the base 105. In the illustrated embodiment, the stops 231 are the end walls of recessed areas 233 in the plate 213 arranged to receive the ends of the lugs 183 when the lock 211 is received in the open end 165 of the base 105.

As illustrated in FIG. 2A, the recessed areas 233 and the stops 231 are suitably positioned in close proximity to the posts 215. For example, the recessed areas are suitably separated from the posts by a distance in the range of about 0.1 inches to about 6.0 inches, more suitably in the range of about 0.1 inches to about 0.5 inches, and still more suitably in the range of about 0.2 inches to about 0.1 inches. The recessed areas 233 are also suitably in radial alignment with the adjacent post 215. For example, the posts 215 in the illustrated embodiment are spaced radially inward of the recessed areas 233. Because of the relatively close proximity of the recessed areas 233 and the stops 231 to the posts 215, there is a limited amount of material in the lock separating the stops from the frangible portions 221 connecting the posts to the plate 213. This limits the amount of play in the lock 211 due to material straining when forces are applied to the lock and makes it less likely that someone could take the cover 131 off the base 105 without breaking the lock 211. It will also be appreciated that when the lock is applied to the display case 101, the plate 213 is positioned to block insertion of lugs 183 into the relatively wider portion 191 of the openings 187 so if someone does manage to remove the cover 131 (e.g., by breaking the lugs 183), it will be difficult (if not impossible) to replace the cover without removing the lock 211.

The display case 101 is suitably configured to limit access to the posts 215 and the openings 217 once the lock is applied. For example, in the illustrated embodiment, the lock 211 includes a flange 219 (e.g., a substantially cylindrical flange) extending generally upwardly from the plate 213 (e.g., from an inner margin of the plate). The top of the flange is adjacent (e.g., in contact with) a downward facing shoulder 227 on the base 105 when the posts 215 are inserted all the way into the openings 217. Further, the outer margin of the plate 213 is suitably adjacent the inner surface of the lower sidewall 111 of the base 105 such that the posts 215 and openings are substantially enclosed by the lock 211 and base 105 once the lock has been applied to the display case 101. The lock 211 suitably has a hollow center aligned with the hollow center 161 of the base 105 so the lock does not obstruct viewing the bottom of the ball 11 through the transparent pedestal 151.

A suitable lock 211 can be made from polycarbonate, ABS, acrylic and the like. The lock 211 is suitably a unitary structure and can be made using commercially available injection molding technology.

The base 105, cover 131, pedestal 151 and/or lock 211 can be treated to have a protective coating or glazing on exterior surfaces of their bodies. Various coatings or glazings can be applied to provide scratch resistance, reduce glare, control static, and/or to provide protection against ultraviolet and/or infrared radiation. For example, a Magnetron Sputtered thin film multi-layered anti-reflective coating (e.g., Optium Museum Acrylic® coating, commercially available from Tru Vue, Inc. of McCook, Ill.) can suitably be applied to one or both sides of each part of the display case 101. The Optium Museum Acrylic® coating is an abrasion resistant, anti-reflective coating that transmits about 96% of visible light and blocks about 98 percent of ultraviolet light. Further, non-yellowing agents can be added to the materials used for the cover 131 and pedestal 151 to limit discoloration over time.

In the illustrated embodiment, a label 201 (FIG. 2A) displaying information about the ball 11 such as a description of the ball and certification of the ball's authenticity and/or condition, is secured to the upper sidewall 121 of the base 105. The label 201 is suitably a generally rectangular strip applied (e.g., by a suitable adhesive) to the upper sidewall 121 so the label forms a band extending at least part of the way around the perimeter of the upper sidewall. The label 201 is viewable through the sidewall 139 of the cover 131 because the entire sidewall of the cover in the illustrated embodiment is substantially transparent to visible light.

The cover 131 limits access to the upper sidewall 121 of the base 105 when the cover is on the base. The inner surface of the cover sidewall 139 is suitably shaped to conform to the outer surface of the upper sidewall 121 of the base 105. When the cover 131 is on the base 105, the cover limits access to the label 201 because the label is sandwiched between the upper sidewall 121 of the base and the cover (FIG. 3A). Accordingly, once the irreversible lock 211 has been applied, the lock 211 also makes it difficult (if not impossible) to replace, remove, or alter the label 201 without destroying one or more parts of the case 101 and/or leaving evidence of the tampering. It is understood that the label 201 can be placed elsewhere within the display case 101 and be protected against tampering within the scope of the invention. Further, a label can placed on the exterior of the display case within the scope of the invention or omitted entirely whenever circumstances make absence of a tamper resistant label acceptable.

To use the display case 101, a person places a ball 11 (or other item) on the pedestal 151 and places the cover 131 over the top of the ball. If the elevation of the pedestal 151 needs to be adjusted, the cover 131 is removed and one or more spacers 171 are added or removed to raise or lower the pedestal as necessary so the ball 11 will be lightly compressed between the pedestal and the cover when the cover is secured to the base. When any adjustments to the pedestal 151 elevation are complete, the cover 131 is secured to the base 105 using the bayonet connection 181.

At this point, the connection between the cover 131 and the base 105 is releasable. This allows the ball to be taken out of the display case for examination or to rotate the ball so it can be displayed in a different orientation. There is no need to include the lock 211 or to apply the lock if one is included with the display case 101 unless the security of the lock is desired.

The base 105, cover 131, and pedestal 151 can suitably be sold directly to the public through various retail outlets and/or sold to customers by reputable authorized dealers. It is contemplated the distribution of locks 211 can be limited so the only way for a customer to get a lock is to go through an authorized dealer/expert (a person or company) that provides authenticating and/or grading services for sports memorabilia. Further, after the authorized dealer has authenticated and/or graded a ball 11 or other piece of sports memorabilia, the dealer can place the item in a display case 101 (along with a label 201 if desired) and apply the irreversible lock 211 to the case before relinquishing control of the item and its case to the customer. Because the general public does not have access to a supply of locks 211, it will be more difficult for a member of the public to remove the lock and secretly replace it with a different lock.

It is also contemplated that various additional security measures can be added to the locks 211 to provide increased security. For example, one or more distinguishing features can be included surreptitiously in the locks 211 to enable authorized personnel to distinguish locks that were obtained through authorized distribution channels from locks obtained in other ways. Further, the particular distinguishing features can be varied from time to time and/or from one distribution channel so that if there is any misuse of the locks 211 that are distributed through authorized channels the distinguishing features can be used to help identify and eliminate the source of the misuse.

Further, it is contemplated that the locks 211 can be constructed from a material that is susceptible to being branded by a small branding iron that enables authorized dealers to apply a security code and/or number 251 (e.g., a serial number) to a lock to associate a particular lock with the dealer's records of the certification it provided for the item enclosed in the case 101 locked by that particular lock 211. A suitable branding head having changeable characters for branding serial numbers and/or alphanumeric codes into locks 211 for security purposes can be obtained from Branding Irons Unlimited of Canoga Park, Calif.

The ability to apply security codes/numbers 251 to the locks 211 with a branding iron allows each authorized dealer to use its own security coding and/or numbering system without requiring the manufacturer of the locks to make different sets of locks for different dealers. Further, the dealer retains complete control over how security codes are branded into the locks 211, thus eliminating the possibility that anyone upstream in the distribution channel could misuse information about the dealer's security code and or tamper with security codes for fraudulent purposes (such as by applying the same security code to more than one lock 211).

Figure 8:
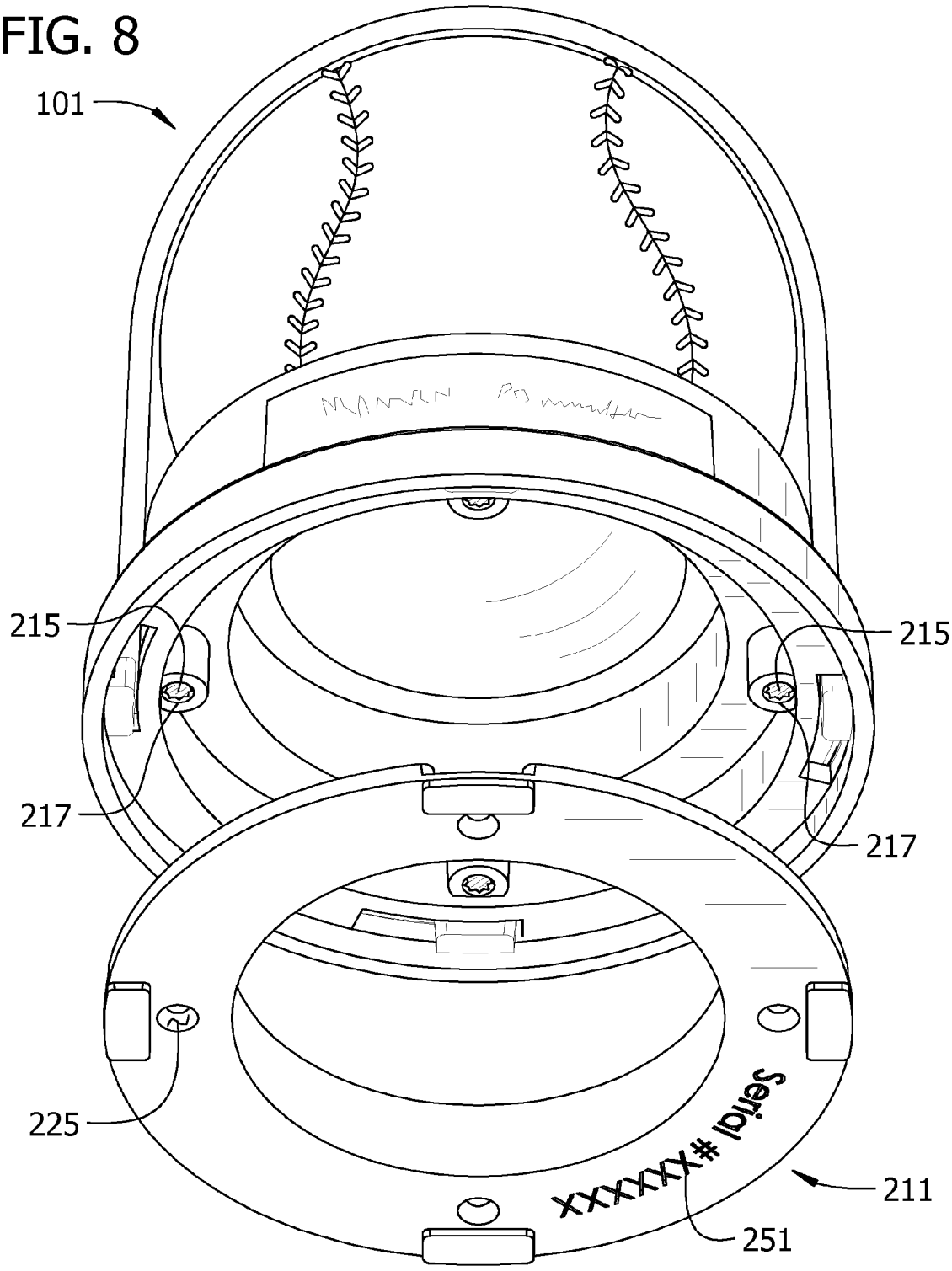
FIG. 8 is a perspective of the ball display case illustrating damage caused by unauthorized removal of a lock from the display case.

If someone tries to remove the lock 211 once it has been applied, the frangible portions 221 of the lock 211 break, leaving the posts 215 stuck in the openings 217 in the base 105 (as illustrated in FIG. 8). The posts 215 from the original lock obstruct insertion of the posts of a new lock into the openings 217 in the base 105. If someone digs the posts 215 out of the openings 217, they will almost certainly leave marks on the base 105, which would be evidence of tampering. If someone were to break the posts 215 off a new lock 211 or try to replace the original lock, the lock would not have any structure to retain the lock on the base 105. Glue or another adhesive could be used to hold the broken lock on the base 105, but the glue/adhesive would need to be applied to the plate 213 and/or to the base outside the openings 217. The presence of any such glue or adhesive outside the openings would be evidence of tampering. Further, evidence of the tampering could be discovered by looking into the dimples 225 to inspect the frangible portions 221 of the lock for signs of damage caused by breaking the posts 215 from the plate 213.

Although evidence of tampering might not be apparent until the lock 211 is removed, it is contemplated that the closing of a sale of a valuable item can include removal of the lock 211 from the base 105 in the presence of reputable witnesses to inspect the display case 101 for evidence of tampering, including presence of marks on the base from digging posts 215 out of the openings 217 or glue/adhesive where it should not be present. After closing the sale, the item can be enclosed and locked in a new display case 101 using a new lock 211 and the records of any certifying agent updated if necessary.

Although there is no authorized distribution of locks 211 directly to the public in the methods described above, it is understood that substantially similar results can be obtained within the scope of the invention by making one type of lock 211 available to the public and limiting public access to "dealer only" locks having one or more features (e.g., color) that distinguish the dealer only locks from the locks that are available to the general public.

It is understood that the display case 101 described above is just one example of the invention and that various modifications may be made without departing from the scope of the invention. For example, the size and shape of the various components of the display case can be changed to adapt the case to display different kinds of sports memorabilia. Further, the releasable connection between the cover and base can be modified from the bayonet connection 181 described above. For instance, the cover can be designed so translational movement (instead of rotational movement) of the cover moves one or more lugs into a narrower portion of an opening. It is also possible to construct an irreversible lock that is secured to another part of the case, such as the cover, instead of the base within the scope of the invention.

Also, terms associated with a particular orientation, such as top, bottom, upper, lower, side, etc., are used in reference to the orientation of the display case as illustrated in the drawings to facilitate understanding of the relation between various parts of the illustrated embodiment. It is understood that the display case can have different orientations from what is illustrated within the scope of the invention. Further, modifications to the display case can result in changes in orientations of various parts relative to one another without departing from the scope of the invention.

When introducing elements of the invention or the preferred embodiment(s) thereof, the articles "a". "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A tamper resistant ball display case comprising:

a base;

a cover securable to the base by moving the cover relative to the base from a first position in which the cover is engaged with the base and can be separated from the base without damaging any part of the case and a second position in which the cover is engaged with the base and cannot be non-destructively removed from the base without moving the cover relative to the base away from said second position, the cover and base at least partially enclosing a space for holding the ball when the cover is secured to the base; and a lock adapted for selective application to at least one of the base and the cover such that the lock assumes a locking position in which the lock engages at least one of the cover and the base when the cover is in said second position in a manner that prevents non-destructive movement of the cover away from said second position to separate the cover from the base and that prevents non-destructive movement of the lock out of the locking position, said lock thus being adapted for selectively and irreversibly converting the display case from an unlocked condition in which the cover is releasably secured to the base to a locked condition in which the cover cannot be non-destructively removed from the base.

2. A tamper resistant ball display case as set forth in claim 1 wherein: at least one of the cover and the base has a plurality of openings; the lock comprises a body and a plurality of posts extending from the body; and conversion of the display case from its unlocked to its locked condition comprises inserting the posts into respective openings, the case being adapted so any force applied to withdraw the posts from the openings results in at least one part of the case breaking before the posts are withdrawn from the openings.

3. A tamper resistant ball display case as set forth in claim 2 further comprising an adhesive holding one or more posts in respective openings when the lock is in its locking position.

4. A tamper resistant ball display case as set forth in claim 2 wherein the case is constructed so a force applied to withdraw the posts from the openings results in the lock breaking while the posts are still in the openings.

5. A tamper resistant ball display case as set forth in claim 1 wherein: at least one of the cover and the base comprises a plurality of lugs received in openings in the other of the cover and base; the openings comprise relatively wider portions and relatively narrower portions adjacent the relatively wider portions; the case is constructed so movement of the cover from said first position to said second position comprises sliding the lugs along the openings from the relatively wider portions into the relatively narrower portions; and the lock comprises at least one stop adapted to be positioned to block movement of at least one of the lugs from the relatively narrower portion of a respective opening to the relatively wider portion of the opening.

6. A tamper resistant ball display case as set forth in claim 5 wherein the lock has a recessed area positioned to receive a portion of a respective lug when the lock is in its locking position, the at least one stop being a wall of the recessed area.

7. A tamper resistant ball display case as set forth in claim 6 wherein the lock comprises a body and a plurality of posts extending away from the body, the recessed area being adjacent one of the posts.

8. A tamper resistant ball display case as set forth in claim 1 wherein the lock is a unitary structure.

9. A tamper resistant ball display case as set forth in claim 1 wherein the base has an open end opposite the cover when the cover is secured to the base, the lock being received in the open end of the base when the lock is in said locking position.

* * * * *